US005159305A

United States Patent [19]

Hutchinson

[11] Patent Number: 5,159,305

[45] Date of Patent: Oct. 27, 1992

[54] MAGNET RESPONSIVE VARIABLE DIFFERENTIAL SWITCHING APPARATUS

[75] Inventor: Harold D. Hutchinson, Malibu, Calif.

[73] Assignee: Harwil Corporation, Santa Monica, Calif.

[21] Appl. No.: 819,380

[22] Filed: Jan. 15, 1992

[51] Int. Cl.[5] ..... H01H 36/00; H01H 36/02

[52] U.S. Cl. ..... 335/207; 335/205; 200/84 C

[58] Field of Search ..... 200/84 C; 335/205, 206, 335/207; 340/623, 686; 361/147; 307/415, 419

[56] References Cited

U.S. PATENT DOCUMENTS 3,407,370 10/1968 Ramstetter et al. ..... 335/206

FOREIGN PATENT DOCUMENTS 1170038 5/1964 Fed. Rep. of Germany .... 200/84 C

*Primary Examiner*—Harold Broome
*Attorney, Agent, or Firm*—William W. Haefliger

[57] ABSTRACT

A variable differential switching apparatus comprising first structure for forming first and second magnetic fields presented sequentially along a travel path, the first field being stronger than the second field; and second structure, including a field responsive element, presented for relative travel along the path in opposite directions, the element and fields and travel path characterized in that as the element encounters the first field during relative travel in one of the directions in unlatched condition, the element is displaced by the first field into a latched condition, and as the element encounters the second field, it remains in the latched condition, and as the element continues to relatively travel in the first direction beyond the second field, it returns to unlatched condition; the element and fields further characterized in that as the element travels oppositely along the travel path, it remains in unlatched condition as the element encounters the second field, and thereafter as the element encounters the first field, the element is displaced into latched condition, and as the element continues to relatively travel in the opposite direction, and beyond the first field, it returns to unlatched condition.

26 Claims, 4 Drawing Sheets

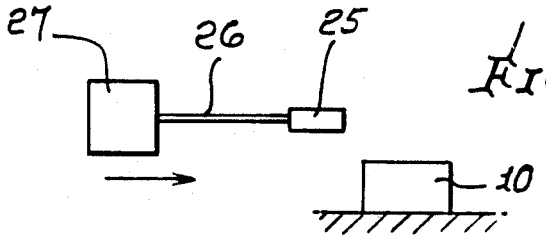
FIG. 7a.
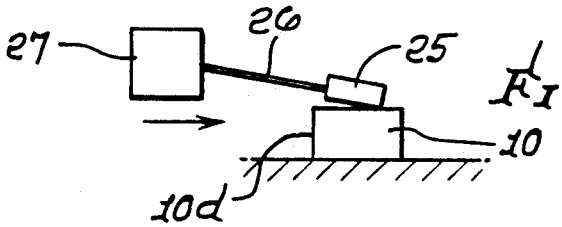
FIG. 7b.
FIG. 9.
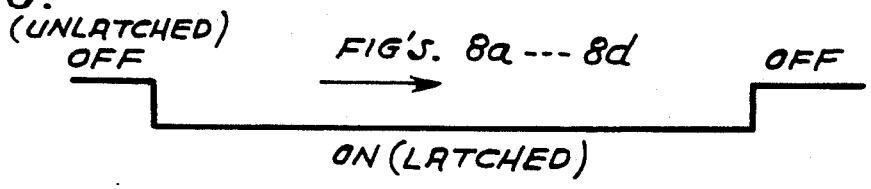
FIG. 10.
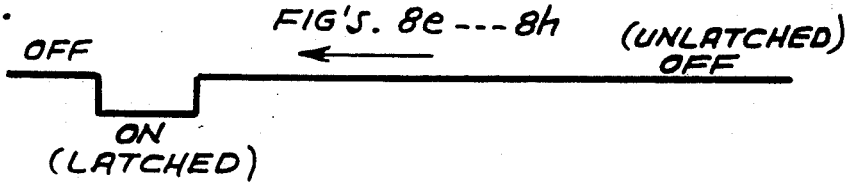
FIG. 11.
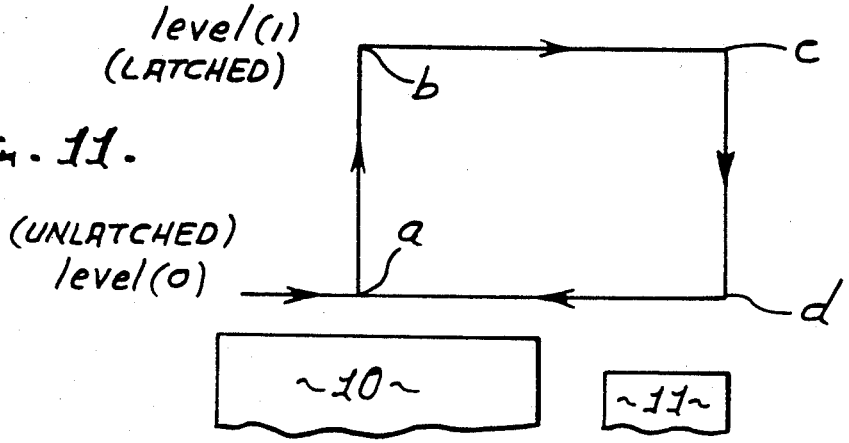

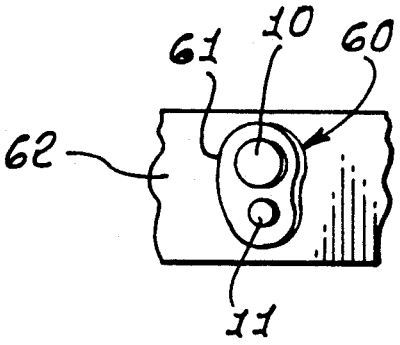
FIG. 12.
FIG. 13.
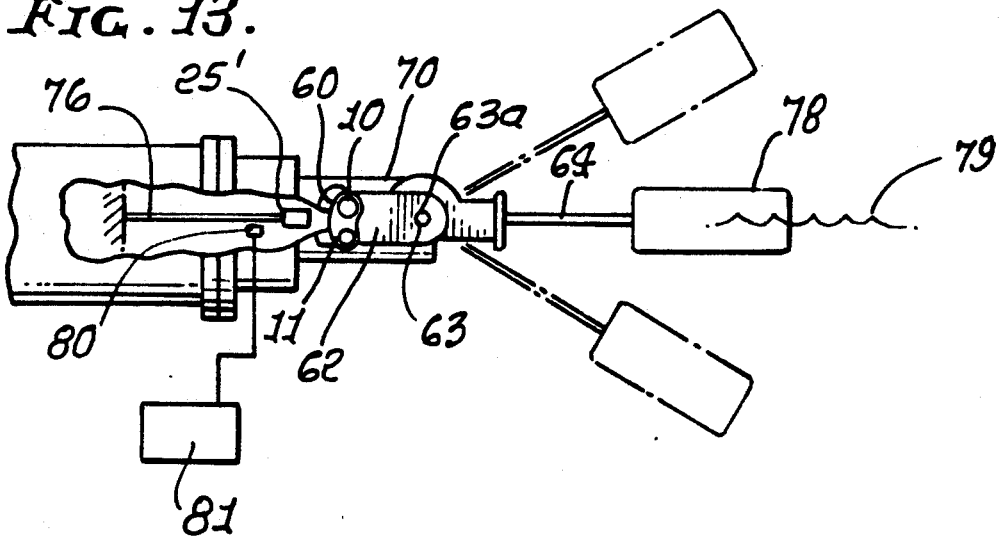
FIG. 14.
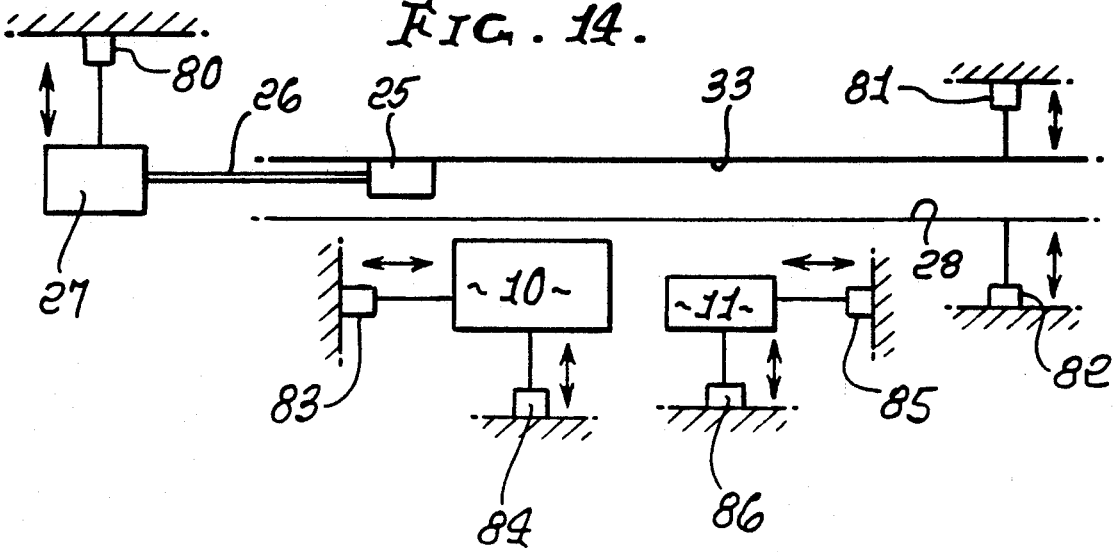

MAGNET RESPONSIVE VARIABLE DIFFERENTIAL SWITCHING APPARATUS

BACKGROUND OF THE INVENTION

This invention relates generally to variable differential switching apparatus, and more particularly concerns the use of magnetic means providing different strength field presented to differentially control a field responsive element depending upon the direction of relative motion of the element and the magnetic means.

In the past, switching operations were effected by magnets in generally the same manner whether or not a magnetically responsive element traveled forwardly or reversely. Thus, if the element were displaced or "latched" by the field of magnet A, as the element passed relatively into that field, the element became unlatched when it passed relatively out of that field, and a switch could be controlled in response to such latching and unlatching. The travel of the element between latched and unlatched conditions, and hence the switching function, was limited by the existence of the field of the magnet A, which in turn was a function of the size of the magnet. Also, no way was known to vary the latching and switching apparatus as a function of travel direction, particularly in the simple and effective manner now afforded by the present invention, using permanent magnets of different field strengths.

There is need for apparatus that will provide variable differential latching and switching operation using permanent magnets in the simple, effective and novel manner as now afforded by the present invention.

SUMMARY OF THE INVENTION

It is a major object of the invention to provide apparatus meeting the above needs. Basically, the apparatus of the invention comprises:

a) first means for forming first and second magnetic fields presented sequentially along a travel path, the first field being stronger than the second field, b) and second means, including a magnetic field responsive element, presented for relative travel along the path in opposite directions, the element and field and travel path characterized in that as the element encounters the first field during relative travel in one of the directions in unlatched condition, the element is displaced by the first field into a latched condition, and as the element encounters the second field, it remains in the latched condition, and as the element continues to relatively travel in the first direction beyond the second field, it returns to unlatched condition, c) the element and fields further characterized in that as the element travels oppositely along the travel path, it remains in unlatched condition as the element encounters the second field, and thereafter as the element encounters the first field, the element is displaced into latched condition, and as the element continues to relatively travel in the opposite direction, and beyond the first field, it returns to unlatched condition.

It is a further object of the invention to provide a first magnet to produce the first field and a second magnet to produce the second field, the two magnets relatively offset in a direction corresponding to the travel paths. As will appear, one or both of such magnets typically comprise a permanent magnet or magnets, and the two magnets may be permanent magnets, the first stronger, or larger, than the second.

A further object includes the provision of mechanism carrying the field responsive element for travel relative to the first means; and such mechanism advantageously may include a support, and a spring carried by the support and biasing the element toward unlatched condition. In one form of the invention, the spring comprises an elongated spring arm carrying the field responsive element.

Yet another object includes the provision, in the basic combination, of a pivot on the support defining an axis about which the travel path extends. In one highly effective form of the invention, the first means travels about the axis relative to the field responsive element, during the relative travel described. A float may, for example, be operatively connected with the first means for rotary displacement about the defined axis, as water level rises or falls. The need for two vertically spaced and separate water level sensors is thereby obviated. The large and variable differential provided by this invention eliminates need for the separation distance of two independent level switches. Thus, a single differential-type level switch can provide a pump up, pump down system which previously required two level switches plus interface electronics.

These and other objects and advantages of the invention, as well as the details of an illustrative embodiment, will be more fully understood from the following specification and drawings, in which:

DRAWING DESCRIPTION

Figure 3:
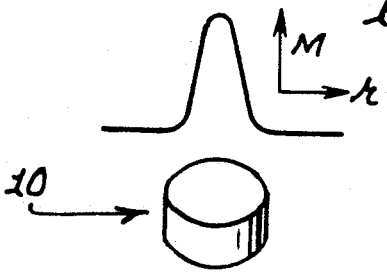
FIG. 3 is a view of the FIG. 1 magnet showing magnetic field strength as a function of distance from the magnet front surface.
Figure 4:
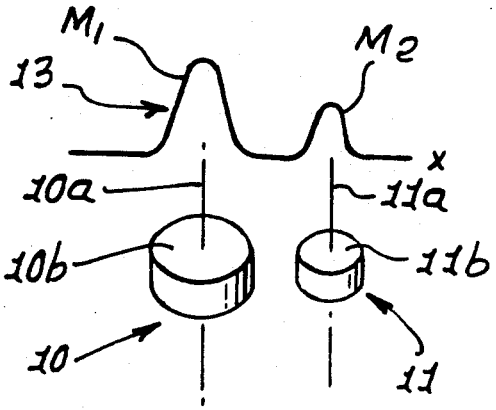
FIG. 4 is a view like FIG. 3 showing two magnets, and two different field strengths, along the "x" axis.

FIGS. *7a* and *7b* are views showing unlatched and latched conditions for a magnetically responsive element, and relative to a FIG. 3-type magnet;

FIGS *8a–8h* are views showing travel in opposite directions of a magnetically responsive element, relative to a pair of magnets as in FIG. 4, and also showing unlatched, latched and unlatched relative positions during such travel;

FIGS. 9 and 10 are graphs showing latched and unlatched conditions for forward and rearward direction relative travel, as respects the magnetically responsive element shown in FIGS. *8a–8h;*

FIG. 11 is a hysteresis diagram;

FIG. 12 is a view showing two magnets, as in FIG. 4, carried by a support;

FIG. 13 is a side elevation showing a float actuator pivotally supported to effect travel of the FIG. 12 magnets relative to a magnetically responsive element; and FIG. 14 shows the provision of adjustment means for the magnets and the magnetically sensitive element.

DETAILED DESCRIPTION

Figure 1:
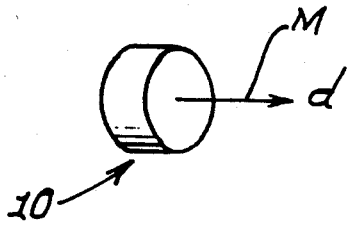
FIG. 1 is a perspective view of a ceramic disc magnet.
Figure 2:
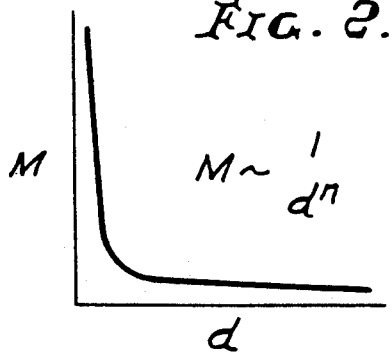
FIG. 2 is a graph.

In FIG. 1, a permanent magnet, as for example the ceramic disc magnet 10 shown, has a magnetic field as represented by vector M extending axially of (i.e., off the face of) the disc, the vector length representing maximum field strength along that axis. That field strength varies, as better seen in FIG. 2 and specifically inversely with radial distance, where n varies from 2 to 3.

In FIG. 3, the graph of field strength M as a $$M \sim \frac{1}{d^n}$$

function or radius r is shown, as related to the magnet 10 itself.

In FIG. 4, the magnet 10 is again shown, along with a second and smaller ceramic disc magnet 11, spaced laterally of 10. The axes 10*a* and 11*a* of the two magnets are parallel, and the top 11*b* of 11 may or may not be spaced below the level of the top 10*b* of magnet 10; however, the field strengths $M_1$ and $M_2$ of the two magnets as functions of lateral distance X appear as shown in waveform 13, field $M_2$ being substantially less than $M_1$.

Figure 5:
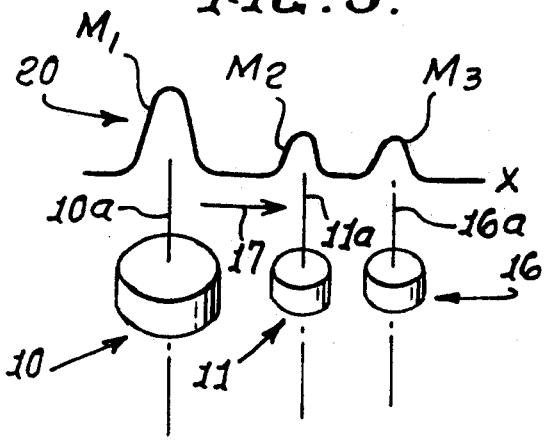
FIG. 5 is a view like FIG. 4 showing three magnets, and three field strengths, along the "x" axis.

In FIG. 5, the two magnets 10 and 11 of FIG. 4 are again shown, along another magnet 16, like magnet 11, and spaced in relative travel direction 17. The axes 10*a*, 11*a* and 16*a* of the three magnets extend in parallel relation, and the tops of the two like magnets 11 and 16 are at the same level, below the flat top of magnet 10. The field strengths of the two magnets, as function of the lateral distance X, appears as shown in the waveform 20, field $M_2$, $M_3$ being substantially less than field strength $M_1$.

Figure 6:
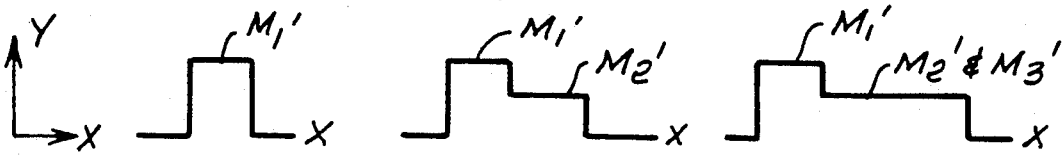
FIG. 6 is a graph showing idealized field strengths along the "x" axis, for the FIGS. 3, 4 and 5 magnet arrangements.

Idealized step function magnetic fields $M_1'$, $M_2'$ and $M_3'$, corresponding to $M_1$, $M_2$ and $M_3$ appear in FIG. 6, showing fields for FIG. 1, FIGS. 4 and 5, respectively.

Latching and unlatching of a field responsive element, as a function of its travel relative to fixed magnet 10, is shown in FIGS. 7*a* and 7*b*.

In FIG. 7*a*, element 25, which may comprise a permanent magnet, is supported in cantilever relation on a spring arm 26, the opposite end of the arm carried by a support 27. As parts 27, 25 and 26 are moved to the right from FIG. 7*a* to FIG. 7*b* position, the element 25 is first attracted by the field of magnet 10, and closes toward 10, bending arm 26, the element 25 thus being latched or coupled. As parts 25, 26, and 27 move further to the right, element 25 moves beyond edge 10*d* of the magnet, becomes unlatched and moves back up to its original position. These same functions occur as the elements 25, 26 and 27 are moved oppositely, to the left, i.e., latching occurring while the element 25 is sufficiently in the field $M_1$ of magnet 10.

Figure 8A:
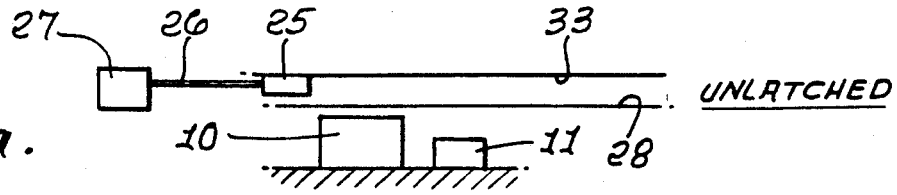
Figure 8B:
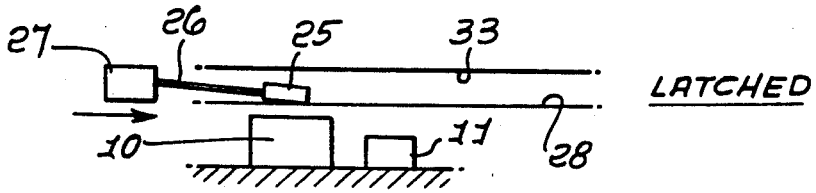
Figure 8C:
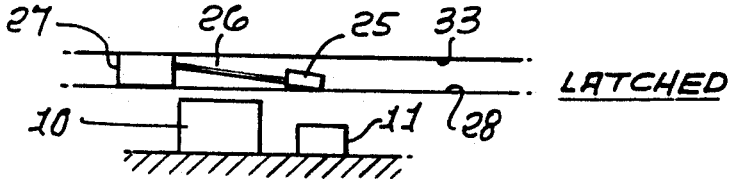
Figure 8D:
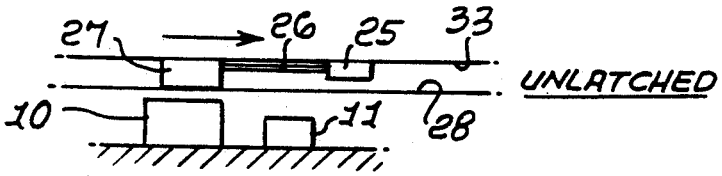
Figure 8E:
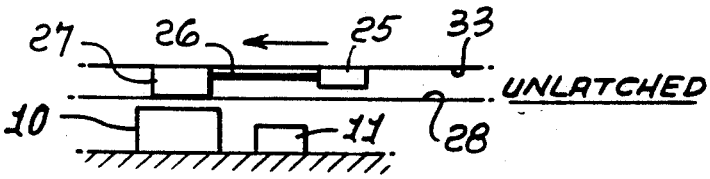
Figure 8F:
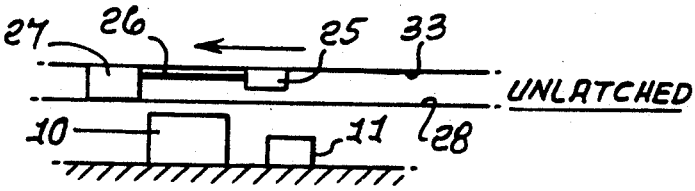
Figure 8G:
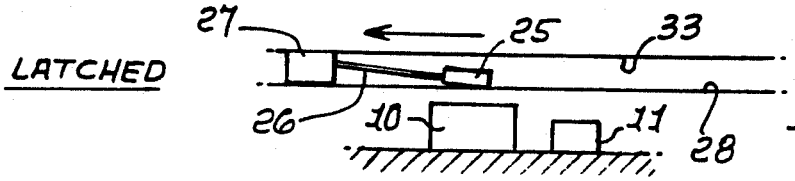
Figure 8H:
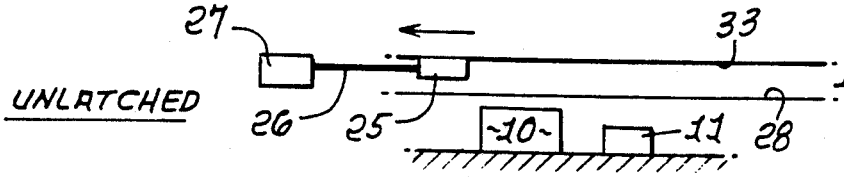

Refer now to FIGS. 8*a*–8*d* wherein two fixed magnets 10 and 11 are employed, as in FIG. 4. In FIGS. 8*a* and 8*b*, element 25 moves rightwardly and from unlatched to latched position, due to its travel into field $M_1$ of 10. A lower stop 28 limits motion of the element toward 10. Now, referring to FIG. 8*c*, as the element 25 moves out of the field $M_1$ of 10 and into the weaker field $M_2$ of 11, it remains in latched or coupled position, wherein it remains while it passes over 11, the field $M_2$ being sufficient for this purpose, but yet substantially less than $M_1$. Later, as seen in FIG. 8*d*, as 25 moves beyond the field $M_2$, it is no longer magnetically attracted downwardly sufficiently to resist upward spring urging exerted by arm 26, so that 25 moves back up into unlatched position, i.e., against upper stop 33. See also FIG. 9.

A different (differential) latching and unlatching sequence occurs upon reverse (opposite) direction travel of 25, 26 and 27. See FIGS. 8*e*–8*h*. As part 25 moves leftwardly over magnet 11, the field $M_2$ of 11 is insufficient to pull 25 downwardly into latched position, because of the increase separation distance between the magnetically sensitive elements and the upper surface of magnet 11, so that element 25 remains unlatched. It is only latched when it arrives over magnet 10 to be pulled downwardly by stronger field $M_1$; and 25 is then unlatched when it moves leftwardly out of field $M_1$. Thus, the latching duration is shorter for leftward travel than it is foı rightward travel. This is also shown in FIG. 10.

See also FIG. 11, which is a hysteresis diagram of plot of switching function (latching) vs. position of the magnetically responsive element relative to magnets 10 and 11. At "a", the element 25, at level (O), latches due its arrival over the magnet 10, i.e., under influence of field $M_1$. (Level (l) indicates latching state, and level (O) indicates unlatching state.) At (b) the element 25 is latched. As the element 25 travels to the right beyond 10, it remains latched until it arrives at point (c), the limit of travel of 25 under the influence of magnet 11, i.e., lesser field $M_2$. The element thus unlatches to point (d), at level (O). As the element travels leftwardly over magnet 11, it remains unlatched, i.e., at level (O), until it arrives at point (a), over the magnet 10, where it again latches to point (b), i.e., level (l).

The basic elements, then, of the invention may be summarized as:

a) first means for forming first and second magnetic field presented sequentially along a travel path, the first field being stronger than the second field, b) and second means, including a field responsive element, presented for relative travel along the path in opposite directions, the element and fields and travel path characterized in that as the element encounters the first field during relative travel in one of the directions in unlatched condition, the element is displaced by the first field into a latched condition, and as the element encounters the second field, it remains in the latched condition, and as the element continues to relatively travel in the first direction beyond the second field, it returns to unlatched condition, c) the element and fields further characterized in that as the element travels oppositely along the travel path, it remains in unlatched condition as the element encounters the second field, and thereafter as the element encounters the first field, the element is displaced into latched condition, and as the element continues to relatively travel in the opposite direction, and beyond the first field, it returns to unlatched condition.

In FIGS. 12 and 13, two magnets, 10 and 11, are carried by a cup-shaped, plastic holder 60. The latter is insertible into a recess 61 in a pivoted arm 62; and different holders carrying different permanent magnet combinations may be insertible into recess 61. A pivot axis 63 is defined by a support 70; and a float 78 pivots up and down about axis 63, in response to liquid level 79 changes, as in a water pool. A beam 64 carries the float and pivots about axis 63; and the beam is connected to arm 62.

Support 70 carries the pivot 63*a* defining axis 63, and it also carries an elongated spring arm 76 to extend in cantilever relation toward the magnets 10 and 11. A magnetic field responsive element 25' is carried by the spring arm, to respond to the fields of 10 and 11 as the latter swing, i.e., pivot along a travel path about axis 63. The arm urges the element 25' toward unlatched position, and it becomes latched in response to the swinging of the magnets past the element 25' in accordance with the FIG. 11 hysteresis diagram. Thus, as the magnets swing up as the float falls, the element 25' becomes latched to turn a switch 80 ON, which in turn turns a liquid pump 81 ON, to fill liquid 79 into a pool. The pump stays ON as magnet 11 passes element 25', and only becomes unlatched to turn pump 81 OFF, as magnet 11 passes beyond 25'. Thus, the liquid level has time to rise to a desired upper level in the pool before the pump turns OFF. The need for multiple discrete liquid level sensors (to sense liquid level rise to an upper level in order to turn the pump OFF, and to sense liquid level fall to a lower level in order to turn the pump ON) is avoided.

The apparatus, as described, can be employed in other systems, where hysteresis functioning, as per FIG. 11, is desired.

SUMMARY

Essential to this invention is the utilization of the extremely rapid fall-off of the magnet field surrounding a dipole magnetic source. In accordance with the invention, a strong magnetic field causes a field sensitive element to be drawn closer to the magnet source against a first physical stop separated from the source. The field sensitive element is then moved laterally past the magnet source into a second, but reduced, magnet field which is sufficiently strong to hold the sensitive element against the first stop. If the sensitive element is then moved laterally beyond the second reduced field into a "zero" magnetic field, the sensitive element will be released from the stop position to its original rest position, as for example adjacent a second stop. Further, if the sensitive element is then moved laterally in such a way as to retrace its previous path, it will again encounter the second reduced magnet field. This time, however, the sensitive element is now in its original rest position adjacent the second stop, and which is at a greater distance from the second magnet, and thus in a substantially reduced magnetic field.

The optimal selection of the magnetic properties of the sensitive element, the high and low magnetic fields "seen" by the sensitive element, the physical location of the high and low fields, the separation and location of the rest position and stop position of the sensitive element combine to produce a new and unique system, in which travel by the sensitive element in one direction, along a prescribed path, causes the sensitive element to switch to a given stable state; and when this same sensitive element is then moved in the reverse direction over the same path, the sensitive element switches to a second stable state different from the first stable state. Such a system is, by definition, said to exhibit hystersis. By varying the parameters indicated above, this system exhibits variable hysteresis.

FIG. 14 shown the provision of means to vary the positions of the magnets 10 and 11, and the position of the support 27 for the sensitive element 25 and the stop positions, so as to "tune" the system in order to achieve the functioning referred to. See the actuator 80 to move 27 in direction "y"; actuator 81 to move stop 33 in the "y" direction; the actuator 82 to move stop 28 in the "y" direction; and actuators 83 and 84 to move magnet 10 in the "y" and "x" directions; and the actuators 85 and 86 to move magnet 11 in the "y" and "x" directions. The site of 25 may also be adjusted and the strength of the magnets may be adjusted. Thus the spacial parameters of 10, 11, 25, 33, and 28 may be so adjusted and varied as to achieve the operation or functioning referred to.

The description herein refers to round, ceramic, disk-shaped, permanent magnets 10 and 11, to illustrate the basic principles involved; however, in actual, real world systems, various type of magnetic field-producing elements can be employed, e.g., ceramic, metal, plastic, rubber, electromagnets of various shape, size, field strength, and field geometry. The magnetically sensitive element 27 can be a magnet of any type and geometry, a magnetically sensitive metal armature, and magnetic field sensitive reed switch, or any other magnetic field sensitive material or device. The hysteresis path of the sensitive element relative to the variable strength primary magnetic field can be of any length and shape. In fact, the primary field can be two or three dimensional, as well as one dimensional, as discussed in the patent application.

I claim:

1. In variable differential switching apparatus, the combination comprising a) first means for forming first and second magnetic fields presented sequentially along a travel path, the first field being stronger than the second field, b) and second means, including a field responsive element presented for relative travel along said path in opposite directions, said element and fields and travel path characterized in that as said element encounters said first field during relative travel in one of said directions in unlatched condition, the element is displaced by said first field into a latched condition, and as said element encounters said second field, it remains in said latched condition, and as said element continues to relatively travel in said first direction beyond said second field, it returns to unlatched condition, c)said element and fields further characterized in that as said element travels oppositely along said travel path, it remains in unlatched condition as the element encounters the second field, and thereafter as the element encounters said first field, the element is displaced into latched condition, and as the element continues to relatively travel in said opposite direction, and beyond said first field, it returns to unlatched condition.

2. The combination of claim 1 wherein said first means includes a first magnet to produce said first field and a second magnet to produce said second field, said two magnets relatively offset in a direction corresponding to said travel paths.

3. The combination of claim 2 wherein at least one of said magnets is a permanent magnet.

4. The combination of claim 2 wherein both of said magnets are permanent magnets.

5. The combination of claim 1 including mechanism carrying said field responsive element for said travel relative to said first means.

6. The combination of claim 5 wherein said mechanism includes a support, and a spring carried by the support and biasing said element toward unlatched condition.

7. The combination of claim 6 wherein said spring is an elongated spring arm carrying said element.

8. The combination of claim 6 including a pivot on the support defining an axis about which said travel path extends.

9. The combination of claim 7 including a pivot on the support and defining an axis about which said travel path extends, said first means traveling about said axis during said relative travel.

10. The combination of claim 9 including a float operatively connected with said first means for rotary displacement about said axis.

11. The combination of claim 9 wherein said first means includes a first magnet to produce said first field and a second magnet to produce said second field, said two magnets relatively offset in a direction corresponding to said travel paths, and structure pivotally supported by said pivot and carrying said float and said magnets.

12. The combination of claim 11 including a holder for said magnets removably carried by said structure.

13. The combination of claim 2 including means to adjust the relative positions of said magnets and element and in relation to the magnet field strength to achieve said latched and unlatched conditions.

14. The combination of claim 1 including stops to be engaged by said elements in said latched and unlatched conditions.

15. The combination of claim 14 including means to adjust the positions of said stops.

16. The combination of claim 1 wherein said field responsive element is a reed switch.

17. The combination of claim 1 wherein said field responsive element is a ceramic magnet.

18. The combination of claim 1 wherein said field responsive element is a metallic magnet.

19. The combination of claim 1 wherein said field responsive element is an electro magnet.

20. The combination of claim 1 wherein said field responsive element is a plastic body magnet.

21. The combination of claim 1 wherein said field responsive element is a rubber body magnet.

22. The combination of claim 1 wherein said first means consists essentially of ceramic.

23. The combination of claim 1 wherein said first means consists essentially of metal.

24. The combination of claim 1 wherein said first means consists essentially of rubber.

25. The combination of claim 1 wherein said first means consists essentially of electromagnet material.

26. The combination of claim 1 wherein said first means consists essentially of plastic.

* * * * *